US005746286A

United States Patent [19]

Mlaker

[11] Patent Number: 5,746,286

[45] Date of Patent: May 5, 1998

[54] HYDRAULIC BOOM PLATFORM LEVELING SYSTEM

[75] Inventor: John J. Mlaker, West Allis, Wis.

[73] Assignee: Mat-3, Inc., Waukesha, Wis.

[21] Appl. No.: 708,718

[22] Filed: Sep. 5, 1996

[51] Int. Cl.[6] ..... B66F 11/04

[52] U.S. Cl. ..... 182/2.9; 182/2.1

[58] Field of Search ..... 182/2, 63, 2.1, 182/2.8, 2.9, 2.3

[56] References Cited

U.S. PATENT DOCUMENTS

| | | | |
|---|---|---|---|
| 3,616,940 | 11/1971 | Milner | 182/2 |
| 3,844,378 | 10/1974 | Balogh | 182/2 |
| 4,775,029 | 10/1988 | MacDonald | 182/2 |
| 4,858,723 | 8/1989 | Holmes et al. | 182/2 |

FOREIGN PATENT DOCUMENTS

| | | | |
|---|---|---|---|
| 1189002 | 9/1959 | France | 182/2 |
| 1532543 | 12/1989 | U.S.S.R. | 182/2 |
| 1325402 | 8/1973 | United Kingdom | 182/2 |
| 1366635 | 9/1974 | United Kingdom | 182/2 |

OTHER PUBLICATIONS

Helac Corporation, "HB Series Helical Hydraulic Rotary Actuators".

Paul Weyer, *Machine Design*, "Boosting Performance of Rotary Actuators", Jul. 6, 1989, pp. 50–52 and 54.

*Primary Examiner*—Alvin C. Chin-Shue

*Attorney, Agent, or Firm*—Nilles & Nilles, S.C.

[57] ABSTRACT

A platform leveling system for an aerial lift truck utilizes a master/slave combination of helical hydraulic rotary actuators to automatically level the work platform in response to movements of the boom. For a two-stage aerial lift comprised of a lower boom and an upper boom, a first rotary actuator is coupled to the base of the lower boom, a second rotary actuator is coupled to the elbow where the upper boom is hinged to the lower boom, and a third rotary actuator is coupled directly to the platform and upper boom. Movement of the lower boom relative to the base causes the first rotary actuator to displace a fixed amount of hydraulic fluid, and movement of the upper boom relative to the lower boom caused the second rotary actuator to disperse a fixed amount of hydraulic fluid. The displacement of hydraulic fluid in the first and second rotary actuators (the master units) causes an equal amount of displacement in the third rotary actuator (the slave unit), which results in articulating the platform in direct response to movement of the boom in order to maintain the platform in a level position.

27 Claims, 5 Drawing Sheets

HYDRAULIC BOOM PLATFORM LEVELING SYSTEM

BACKGROUND OF THE INVENTION

1. Field of the Invention

The present invention relates to a hydraulic boom platform leveling system. In particular, the invention relates to a leveling system for the working platform of an aerial boom lift truck which utilizes a master/slave combination of helical hydraulic rotary actuators to automatically maintain the platform in a level position in response to movements of the boom.

2. Background of the Related Art

An aerial lift truck essentially comprises a chassis outfitted with an aerial boom for providing a working platform that can reach high places. Although many configurations exist, an aerial boom often comprises a two-stage boom assembly consisting of a lower boom and an upper boom, with the working platform or bucket attached to the upper boom. Aerial lift trucks are commonly used by electric and telephone utilities to service transmission, distribution and communication lines in the field.

The working platform or bucket must naturally be level in order to provide an adequate and safe working area. Furthermore, the platform must maintain a level position in response to movements of the lower and/or upper booms. Specifically, the aerial boom must have a means for maintaining the platform in a level position in response to raising or lowering the lower boom, and also in response to raising or lowering the upper boom.

One known mechanism for maintaining the platform in a level position comprises a pair of cables connected to the platform and base of the boom and extending down through the center of the aerial boom. One end of each cable is fastened to the platform and the other end to the base of the boom. The two cables, platform and base essentially form a rigid parallelogram in which any movement of the boom—either the lower boom or upper boom—results in an equal amount of movement of the platform, thereby maintaining the platform in a level position.

For an aerial lift which must have a platform which is electrically insulated from the ground in order to perform work on electrical transmission and distribution lines, at least a portion of the upper boom usually is constructed of non-conductive fiberglass. On such a boom, a portion of the cables may comprise a non-conductive fiberglass rod which insulates the platform leveling system. The cable and insulated rod leveling system is a relatively simple and reliable mechanical means for maintaining a level platform on an aerial boom.

It is difficult, however to adapt the cable and insulated rod leveling system for use on some of the larger size aerial lifts, especially those which have one or more telescopic sections. To adapt a cable and rod leveling system for use on a telescopic two-stage boom would, at the least, require the addition of a complicated system of pulleys. Such a pulley system would unduly add to the complexity of fabricating the aerial boom, and, due to its extended height, loses some effectiveness and reliability in maintaining the platform in a level position. Steel cables will stretch over time, and therefore require periodic inspection, adjustment and maintenance. It can be quite difficult, however, to properly inspect cables which are located internally to the boom.

Another known method of maintaining the platform in a level position comprises a hydraulic valve controlled by a gravity activated, pendulum-type switching mechanism mounted on the bucket. As the boom moves and rotates, the pendulum is naturally pulled straight downward, thereby activating the hydraulic valve in order to level the bucket. The pendulum type leveling mechanism inherently lags behind the actual movements of the boom, i.e. the platform must first tilt before the system initiates a leveling maneuver. Quick movements of the boom also cause the pendulum to swing back and forth, which results in subjecting the user to constant and sometimes unexpected adjustments in the position of the platform until the system settles on the neutral position.

A further method of maintaining the platform in a level position involves placing a hydraulic cylinder at each of the pivot joints on the boom to establish what is figuratively referred to as a "hydraulic parallelogram". Specifically, a hydraulic cylinder is placed, for instance, at the pivot joint between the base and lower boom, and a corresponding hydraulic cylinder of matching geometry is placed at the pivot joint at the platform. When the boom is moved, the hydraulic cylinder at the base causes the hydraulic cylinder to move the platform an equal amount. A similar arrangement can be made at the elbow of the boom. However, hydraulic cylinders have a limited stroke, and consequently limit the range of motion of the boom and/or platform. The maximum range of motion that has been achieved on aerial booms with a "hydraulic parallelogram" have been about 110°.

Consequently, there is a need for an improved hydraulic boom platform leveling system which does not have the problems inherent in current systems.

SUMMARY OF THE INVENTION

A platform leveling system for an aerial lift truck which utilizes a set of helical hydraulic rotary actuators for automatically leveling the platform in response to movements of the boom is disclosed.

The platform leveling system of the present invention is adaptable for use on several different configurations of booms, and in particular on an aerial lift comprising a base, a lower boom connected to the base, an upper boom connected to the lower boom, and a platform connected to the upper boom. The system is further designed for use in a telescopic aerial lift in which the lower boom is comprised of a main section and a telescopic section.

The present invention utilizes a master/slave combination of helical hydraulic rotary actuators located at the pivot points of the boom. A rotary actuator converts hydraulic fluid pressure into torque and rotary motion and has a full 360° range of motion. A helical hydraulic rotary actuator in particular is comprised of a housing, an output shaft, and an internal piston. Rotation of the housing relative to the output shaft causes the internal piston to reciprocate and thereby displace a fixed amount of hydraulic fluid. The present invention utilizes the displacement of hydraulic fluid in the master unit to cause an equal amount of displacement of hydraulic fluid in the slave unit. Therefore, by coupling a set of helical hydraulic rotary actuators to the joints in the boom and by hydraulically interconnecting the actuators together, rotation of boom consequently results an equal and opposite amount of rotation of the platform, thereby maintaining the platform in a level position.

In particular, the leveling platform system of the present invention consists of three helical hydraulic rotary actuators—two master units and one slave unit. One master unit is located at the base hinge pin where the lower boom is connected to the base, and the second master unit is located at the elbow of the aerial lift where the upper boom is connected to the lower boom. The third helical rotary actuator (the slave unit) is located at the tip of the upper boom where the platform is connected.

The three units are hydraulically inter-connected so that the displacement of fluid in either the base actuator or the elbow-actuator (the two master units) causes an equal amount of displacement of fluid in the platform actuator (the slave unit). Specifically, when the lower boom is moved relative to the base, the base actuator displaces a fixed amount of hydraulic fluid. The displaced fluid from the base actuator in turn causes the platform actuator to rotate an equal and opposite amount as to what the base actuator was rotated. Similarly, when the upper boom is moved relative to the lower boom, the elbow actuator displaces a fixed amount of hydraulic fluid. The displacement of fluid by the elbow actuator similarly causes the platform actuator to rotate an equal and opposite amount as to what the elbow actuator was rotated. This results in a leveling action to take place at the platform.

The platform leveling system presented herein further includes for safety precautions a holding valve and cross-over relief valve. In the event of a break in the hydraulic line between the actuators, the holding valve, which is connected directly to the platform actuator, will lock the platform in its relative position. The cross-over relief valve relieves excess pressure in the event that hydraulic pressure exceeds the range of limits of the platform leveling system. The system is further provided with a tilt valve which can be used to adjust the platform angle. In addition, the platform tilt feature can be used to empty water and other debris from the bucket as well as tilt the bucket for emergency rescue of injured personnel.

The principal objects of the invention are therefore to provide a hydraulic leveling mechanism for leveling the working platform or bucket of the aerial lift; to provide a platform leveling system especially adapted for use on a telescopic, two-stage aerial lift; to provide a system which automatically levels the platform in response to movement of any stage of a multiple stage aerial boom; to provide a system which includes adequate safety features in the event of a loss or excess of hydraulic pressure; and to provide a reliable leveling system adaptable for use on a number of different types of aerial booms.

Other objects and advantages of the invention will become apparent from the following description which, taken in conjunction with the accompanying drawings, sets forth by way of illustration and example certain embodiments of this invention.

BRIEF DESCRIPTION OF THE DRAWINGS

The drawings, which constitute part of this specification and include exemplary embodiments of the present invention, include the following.

DETAILED DESCRIPTION OF THE INVENTION

Figure 1:
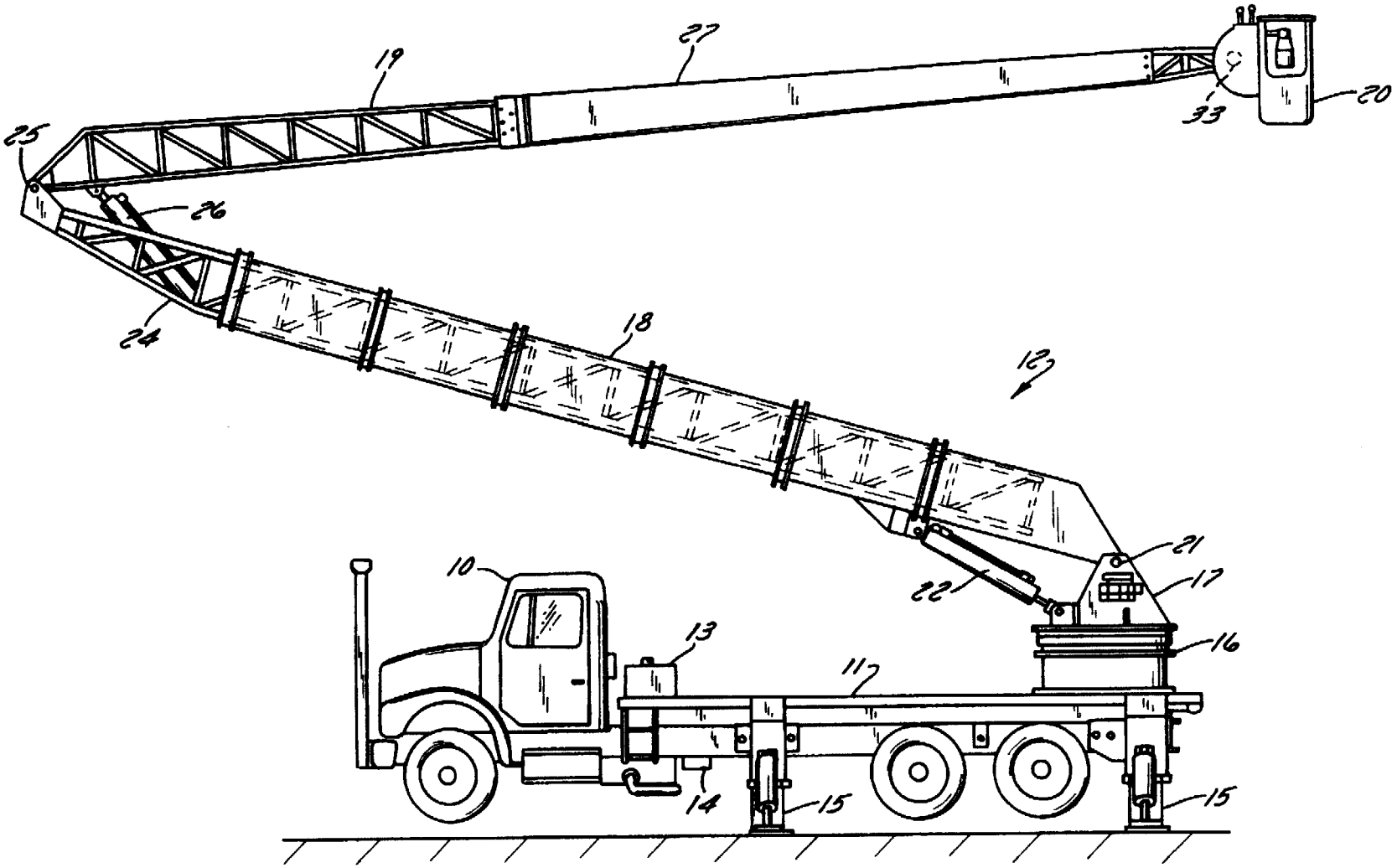
FIG. 1 is a side elevation view of an aerial lift truck.
Figure 2:
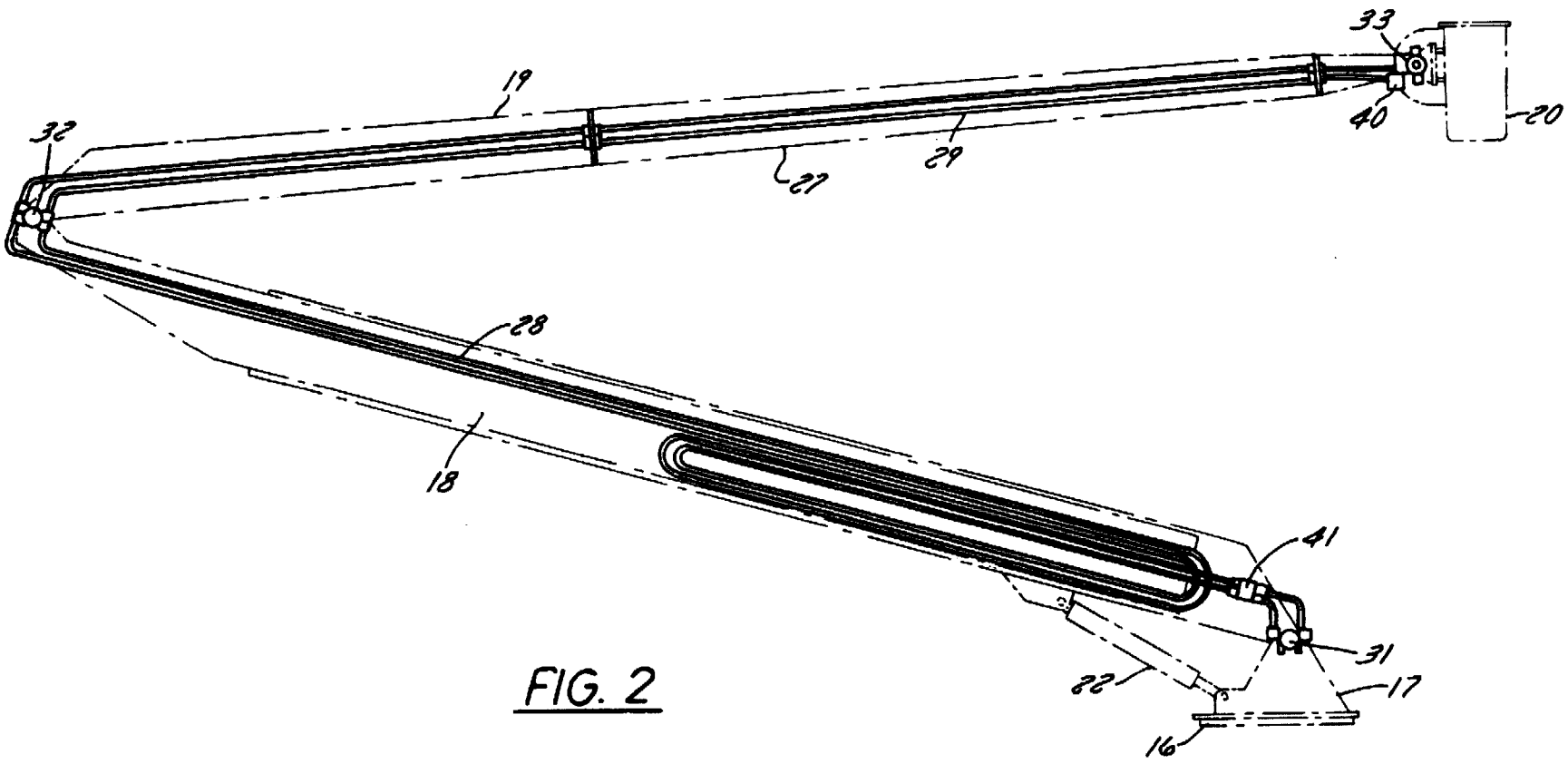
FIG. 2 is a side sectional view of the hydraulic boom platform leveling system of the present invention.

Referring to FIG. 1, an aerial lift truck generally comprises a chassis 10, a bed frame 11 mounted on the chassis, and an aerial boom assembly 12 mounted on the bed frame. The vehicle further includes a hydraulic reservoir 13 and pump 14 to operate the boom, and a set of outriggers 15 to stabilize the boom during its operation.

The aerial boom assembly 12 generally comprises a turntable 16 to rotate the boom relative to the chassis, a base 17 mounted to the turntable, a lower boom 18 connected to the base, an upper boom 19 connected to the lower boom, and a working platform or bucket 20 connected to the upper boom. The lower boom 18 is pivotally connected by a hinge pin 21 to the base on the turntable. A lower boom hydraulic cylinder assembly 22 raises or lowers the lower boom as desired. Thus, movement of the lower boom 18 is accomplished by extending or retracting the lower boom cylinder assembly 22 in order to cause the lower boom 18 to rotate about the hinge pin 21 relative to the base 17.

The lower boom 18 is also telescopic, meaning, that the lower boom 18 comprises a fixed lower section 23, and a slidably extendable, telescopic upper section 24. The telescopic upper section 24 fits within the fixed section 23 of the lower boom 18. A hydraulic cylinder (not shown) mounted internally within the lower boom 18 is used to extend and retract the telescopic upper section 24.

The upper boom 19 is pivotally connected by a hinge pin 25 to the lower boom 18. The point where the upper boom 19 is connected to the lower boom 18 is commonly referred to as the "elbow." An upper boom cylinder assembly 26 is used to raise and lower the upper boom 19. Consequently, movement of the upper boom 19 is accomplished by extending or retracting the upper boom cylinder assembly 26 in order to cause the upper boom 19 to rotate about the elbow hinge pin 25 relative to the lower boom 18. A portion of the upper boom is constructed from a non-conductive fiberglass 27 in order to electrically insulate the platform or bucket 20 from the ground. The platform or bucket 20 is pivotally connected to the end of the upper boom, i.e. the end opposite the elbow.

Referring to FIGS. 2–8, the platform leveling system generally comprises a first rotary actuator 31 coupled to the base 17 and lower boom 18, a second rotary actuator 32 located at the elbow 25 coupled to the upper boom 19 to the lower boom 18, and a third rotary actuator 33 coupled to the upper boom 19 and platform 20. The three rotary actuators may also be referred to as the base actuator 31, elbow actuator 32, and platform actuator 33, respectively. The three rotary actuators are hydraulically interconnected. Specifically, a first hydraulic hose assembly 28 connects the first rotary actuator 31 to the second rotary actuator 32, and a second hydraulic hose assembly 29 connects the second rotary actuator 32 to the third rotary actuator 33.

Reference herein to a rotary actuator means a device, in particular a hydraulically actuated device, in which rotational movement of one member of the device relative to a second member of the device causes a displacement of a fixed amount of hydraulic fluid; conversely, displacement of a fixed amount of hydraulic fluid causes one member of the device to rotate relative to a second member. The preferred embodiment of the invention depicted in FIGS. 2–8 utilizes in particular a helical hydraulic rotary actuator. A helical hydraulic rotary actuator generally comprises a housing, an output shaft, and an internal piston. Rotation of the housing relative to the output shaft causes the internal piston to reciprocate and thereby displace a fixed amount of hydraulic fluid. Conversely, displacement of a fixed amount of hydraulic fluid within the actuator causes the internal piston to reciprocate and thereby rotate the output shaft relative to the housing. Helical hydraulic rotary actuators of the type employed in the present invention are available from, for example, Helac Corporation, Enumclaw, Wash.

The platform leveling system of the present invention utilizes the helical hydraulic rotary actuators mentioned above in a master/slave combination. In other words, the actuators are arranged and hydraulically interconnected such that two of the actuators (at the base and elbow of the boom) effectively act as pumps in order to drive the third actuator (at the platform).

Figure 7:
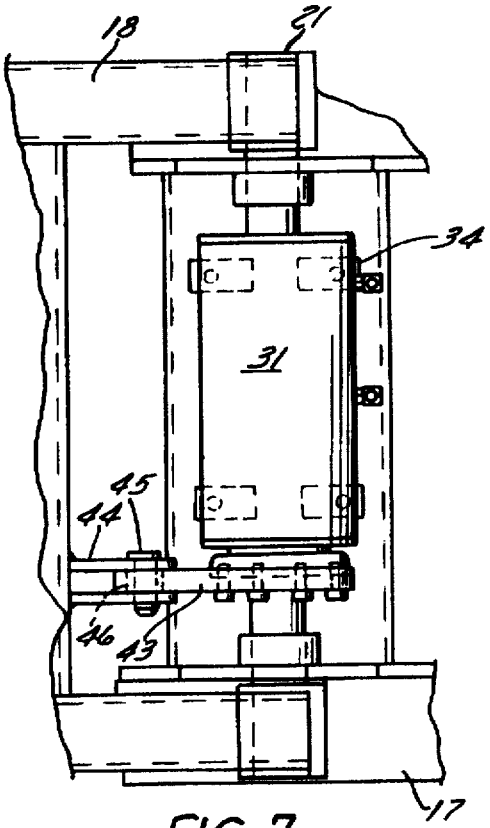
FIG. 7 is a partial top view of the lower boom and base of the aerial lift.
Figure 8:
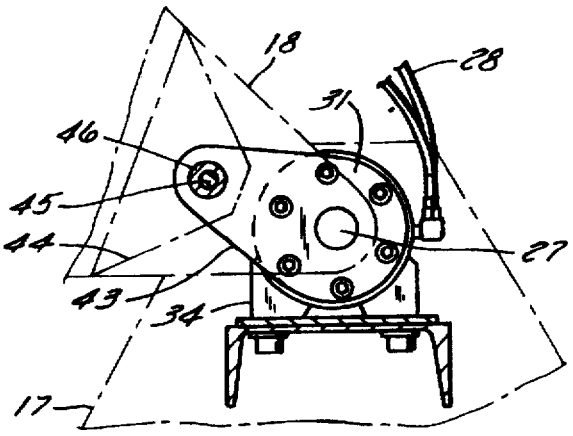
FIG. 8 is a partial side sectional view of the lower boom and base.

Referring specifically to FIGS. 7 and 8, which depicts the first actuator 31 at the base of the boom (i.e. the base actuator), the housing 34 of the base actuator is mounted to the base 17 of the boom, while the shaft 35 of the actuator is attached by a cam 43 to the end of the lower boom 18. When the lower boom 18 is moved relative to the base 17, the shaft 35 of the base actuator 31 rotates causing the internal piston of the base actuator 31 to displace a fixed amount of hydraulic fluid. Since the first actuator 31 at the base of the boom is hydraulically interconnected to the third actuator 33 at the platform, the displaced fluid has only one place to go, namely, to the third actuator 33 at the platform. The displacement of hydraulic fluid by the base actuator 31 thus causes an equal amount of fluid to be displaced in the platform actuator 33, which in turn causes the shaft 39 of the platform actuator to rotate an equal amount at to what the base actuator was rotated. Consequently, rotational movement of the lower boom 18 and resulting displacement of hydraulic fluid in the base actuator 31 results in a leveling action to take place at the platform 20.

Figure 5:
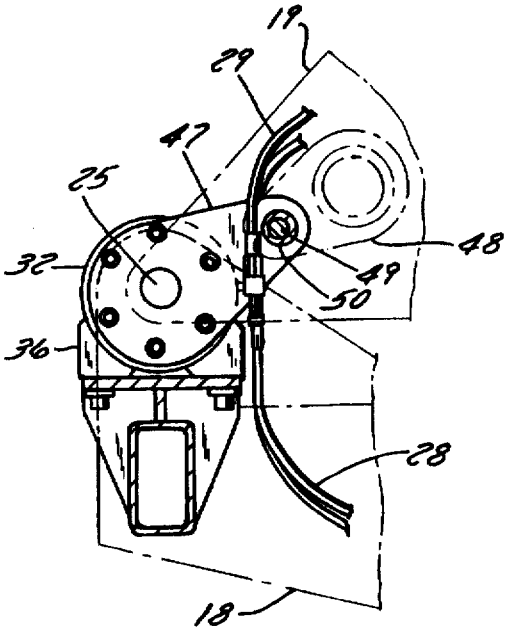
FIG. 5 is a partial side sectional view of the elbow of the aerial lift.
Figure 6:
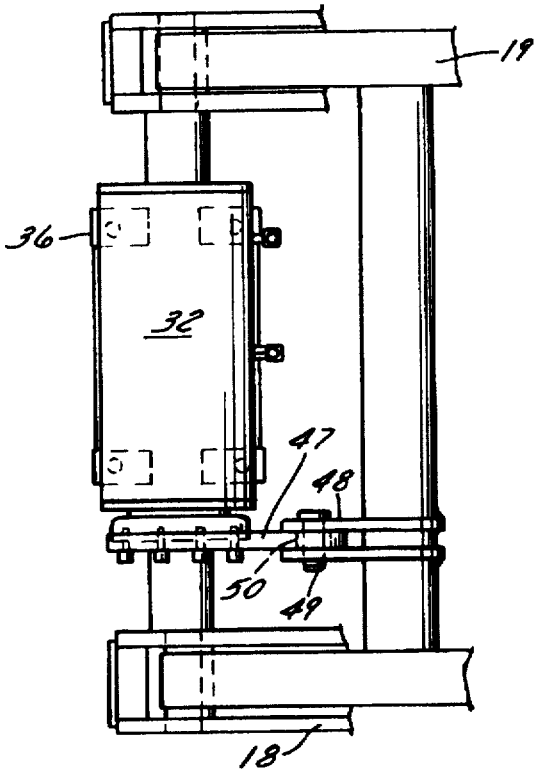
FIG. 6 is a partial top view of the elbow of the aerial lift.

Referring to FIGS. 5 and 6, which depict the second rotary actuator 32 at the elbow of the boom (i.e. the elbow actuator), the housing 36 of the elbow actuator 32 is mounted to the upper end of the lower boom 18, while the shaft 37 of the actuator is attached by a cam 47 to the elbow end of the upper boom 19. When the upper boom 19 is moved relative to the lower boom 18, the shaft 37 of the elbow actuator 32 rotates causing the internal piston in the elbow actuator to displace a fixed amount of hydraulic fluid. Since the elbow actuator 32 is hydraulically interconnected to the platform actuator 33, the displaced fluid has only one place to go, namely, to the platform actuator 33. The displacement of hydraulic fluid by the elbow actuator 32 causes an equal amount of fluid to be displaced in the platform actuator 33, which in turn causes the shaft 39 of the platform actuator 33 to rotate an equal amount as to what the elbow actuator 32 was rotated. Consequently, rotational movement of the upper boom 19 and resulting displacement of hydraulic fluid in the elbow actuator 32 results in a leveling action to take place at the platform 20.

Figure 3:
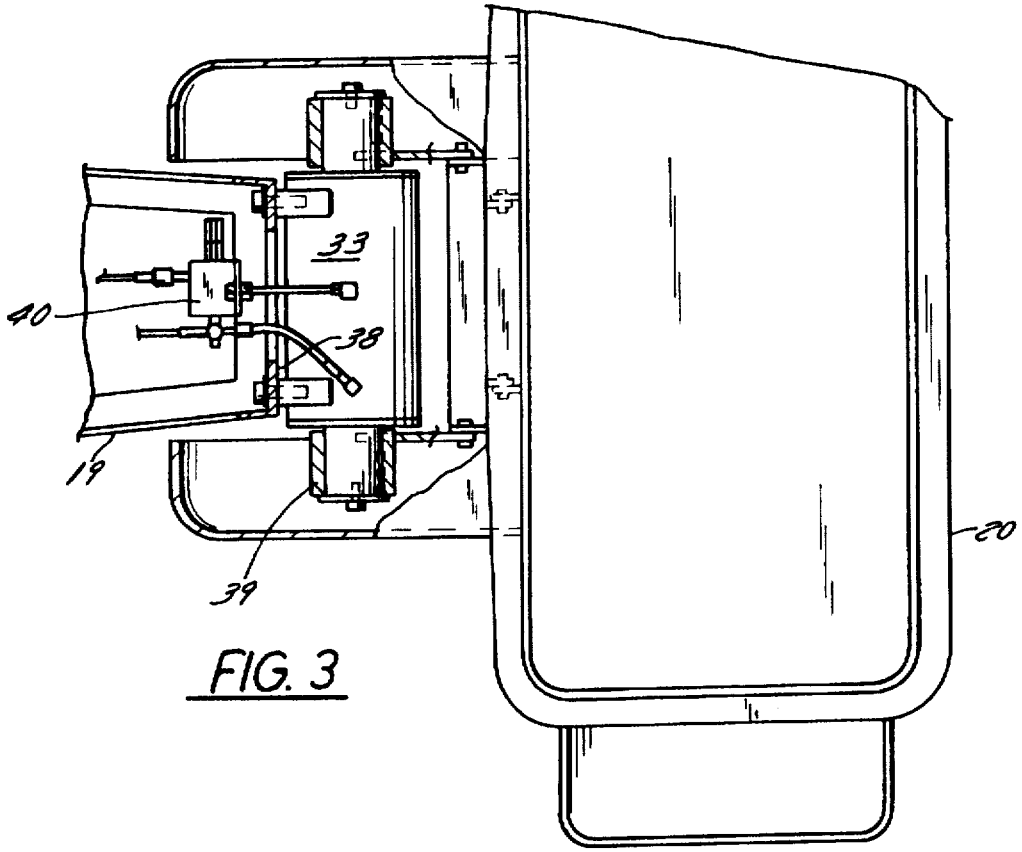
FIG. 3 is a partial top sectional view of a portion of the upper boom and the working platform or bucket.
Figure 4:
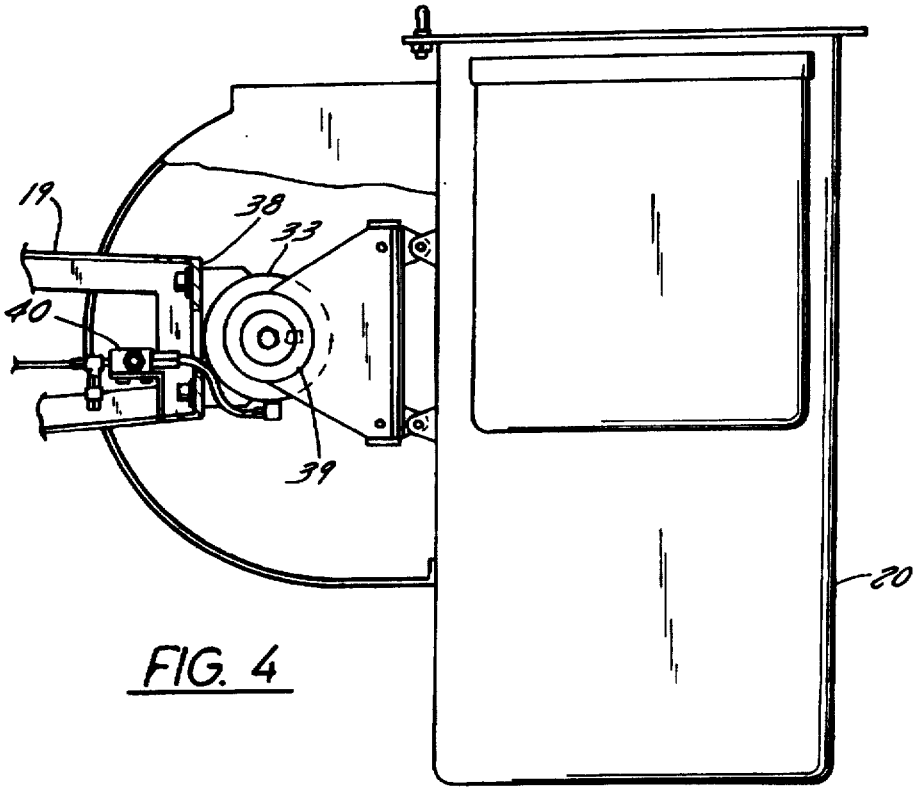
FIG. 4 is a partial side sectional view of a portion of the upper boom and the platform or bucket.

Referring to FIGS. 3 and 4, which depict the third helical rotary actuator 33 at the platform (i.e. the platform actuator), the housing 38 of the platform actuator 33 is mounted to the end of the upper boom 19 and the platform or bucket 20 is attached directly to the shaft 39 of the platform actuator 33. Since the platform actuator 33 is hydraulically interconnected to the base actuator 31 and to the elbow actuator 32, the displacement of hydraulic fluid by either the base actuator 31 or elbow actuator 32 or both, results in the displacement of an equal amount of hydraulic fluid in the platform actuator 33 thereby causing the internal piston of the platform actuator 33 to reciprocate and rotate the shaft 39. Consequently, the platform or bucket 20 rotates an amount equal to the amount of rotation of the lower boom 18 and upper boom 19 which results in maintaining the platform 20 in a level position.

Referring further FIGS. 7 and 8, the axis of rotation of the base actuator 31 is substantially aligned with the base hinge pin 21 which is the axis of rotation of the lower boom 18 relative to the base 17. Similarly, referring to FIGS. 5 and 6, the axis of rotation of the elbow actuator 32 is substantially aligned with the elbow hinge pin 25 which is the axis of rotation of the upper boom 19 relative to the lower boom 18. Because the booms are quite large and extremely heavy, it is difficult to align the axes precisely. Even a slight amount of misalignment would cause an internal stress in the actuator as it is rotated. For this reasons, the base actuator 31 and elbow actuator 32 are provided with a means for relieving stress on the actuators in the event there is a slight misalignment of the axis of rotation of the actuator with the axis of rotation of the relevant boom elements.

Specifically, for the base actuator 31, a cam 43 bolted directly to the shaft 35 of the actuator is fastened to a weldment 44 on the lower boom 18. The means for fastening the cam 43 and weldment 44 together comprises a pin 45 and an eccentric bushing 46. Rotation of the eccentric bushing 46 provides enough "play" for the pin 45 to follow the arc of rotation of the weldment 44 on lower boom 18 and to relieve any stress in the event there is a slight misalignment of the base actuator 31 and base hinge pin 21. Similarly, for the elbow actuator 32, a cam 47 bolted directly to the shaft 37 of the actuator is fastened to a weldment 48 on the upper boom 19. The means for fastening the cam 47 to the weldment 48 comprises a pin 49 and an eccentric bushing 50. Rotation of the eccentric busing 50 provides enough "play" for the pin 49 to follow the arc of rotation of the weldment 48 on the upper boom 19 and relieve any stress in the event there is a slight misalignment of the elbow hinge pin 25.

Figure 9:
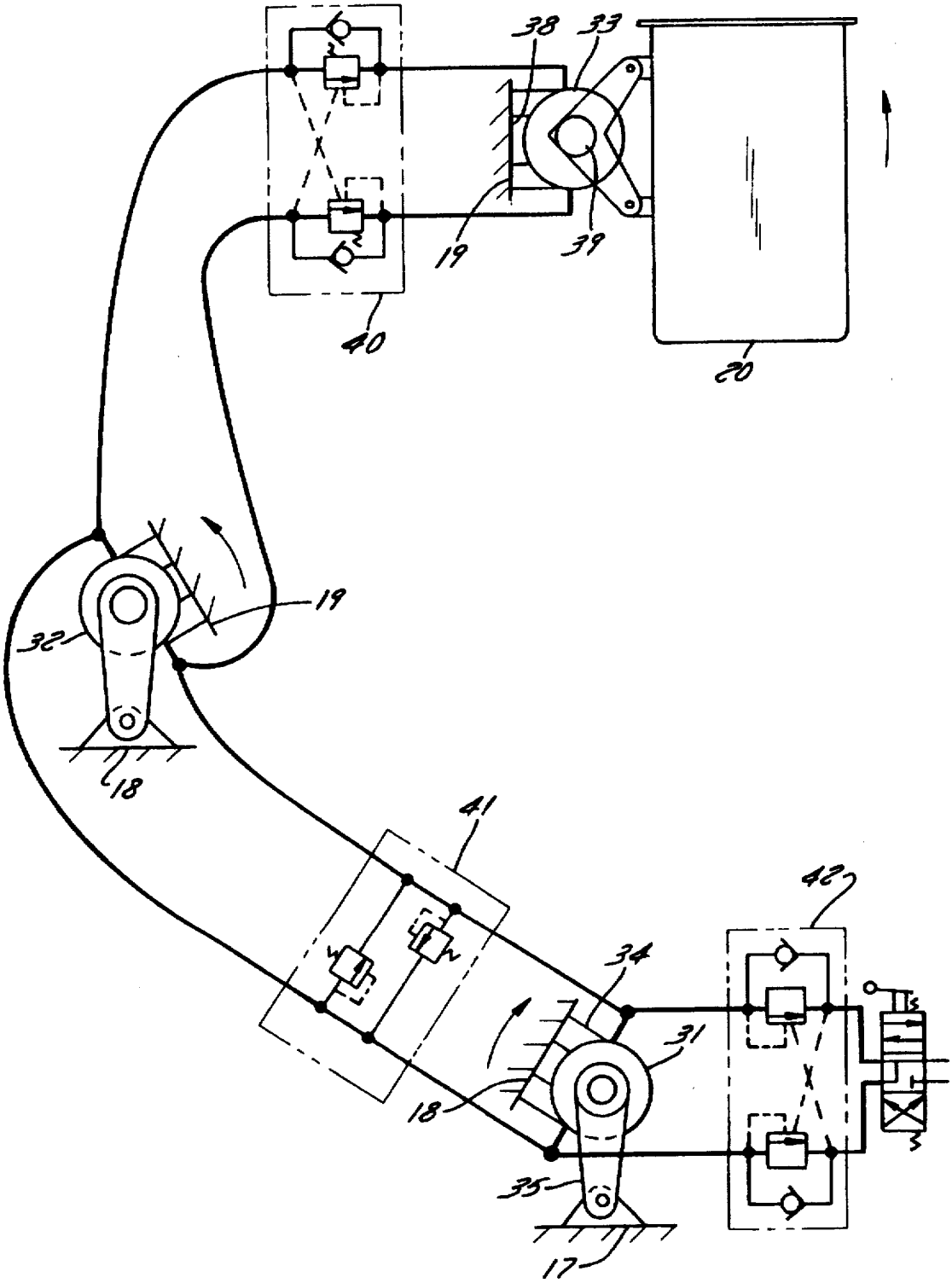
FIG. 9 is a schematic of the hydraulic system of the present invention.

Referring to FIG. 9, the hydraulic system for the platform leveling system is independent of the hydraulic system for the boom and in particular the hydraulic cylinders which operate the boom. Also, the platform leveling system and the main hydraulic cylinders both exert a torque on the boom, but the hydraulic cylinders have a significant mechanical advantage over the rotary actuators of the platform leveling system. In other words, the bucket 20 hanging out from the end of the upper boom 18 exerts a torque of about 1,000 ft./lbs. on the platform actuator 33. Because the platform actuator 33 is hydraulically connected to the elbow actuator 32 and to the base actuator 31, the same amount of torque is transferred to and exerted upon the boom by the elbow actuator 32 and the base actuator 31. However, the hydraulic cylinders at the elbow and base 22 and 26 exert a substantially greater amount of torque—about 60,000 ft./lbs. For this reason, any displacement of hydraulic fluid in the platform leveling system is relieved through an articulation of the platform 20 rather than the boom.

Specifically, fluid displaced by the base actuator 31 when the lower boom 18 is moved will first travel to the elbow actuator 32, but since the hydraulic cylinders 26 at the elbow have a significant mechanical advantage over the elbow actuator 32 (about 60:1), the elbow actuator 32 will not move. Instead the displaced fluid will continue to travel to the platform actuator 33 which does respond to the displacement. Similarly, fluid displaced by the elbow actuator 32 when the upper boom 19 is moved could travel to the base actuator 31, but since the hydraulic cylinders 32 at the base have a significant mechanical advantage over the base actuator 31, the base actuator 31 will not move. Instead the displaced fluid will travel to the platform actuator 33 which responds to the displacement.

The platform leveling system disclosed herein is further provided with a number of safety features, including a means for locking the platform 20 in its position in the event of a loss of hydraulic pressure, a means for relieving excess pressure in the system, and a means for tilting the platform 20 to clear debris and for emergencies. Specifically, a holding valve 40 is directly connected to the load holding side of the platform actuator 33. In the event of a break in the hydraulic lines between the actuators or in the event of some other catastrophic loss of hydraulic pressure in the system, the holding valve 40 will lock the platform 20 in its position relative to the upper boom 19.

Also, at a location relatively close to the base actuator 31, a cross-over relief valve 41 is incorporated into the hydraulic system to relieve excess pressure in the event that the range of limits of hydraulic pressure of the system is exceeded. For example, in the event that debris becomes lodged between the bucket 20 and upper boom 19 in such a manner that the bucket 20 is unable to rotate as the boom is being lowered, hydraulic pressure in the system would continue to build until something failed (e.g. a hose burst). The cross-over relief valve 41 relieves such excess pressure.

The system is further provided with a platform tilt valve 42 built into the base end of the lower boom. The tilt valve 42 can be used to adjust the platform angle. In addition, the platform tilt feature can be used to empty water and other debris from the bucket, as well as tilt the bucket for emergency rescue of injured personnel.

Finally, the hydraulic hose assemblies 28 and 29 of the leveling system presented herein are constructed of a high pressure hydraulic hose (e.g. 5000 psi hose) even though helical hydraulic rotary actuators operate at low pressures (e.g., about 2,000 psi). Helical hydraulic rotary actuators are extremely efficient and operate with a relatively small amount of hydraulic fluid. Since the boom is very high and the hoses are extremely long, high pressure hoses are used to minimize "loss" of hydraulic fluid due to expansion of the hoses.

Although the platform leveling system of the present invention has been described in specific reference to a two-stage, telescopic aerial boom, the system may naturally be modified and adapted for use on other types of booms and aerial lifts, including simple single-stage booms, non-telescopic booms, bridge-work platforms, and so on. Also, other types of hydraulic actuators which convert hydraulic fluid pressure into torque and rotary motion may be used so long as they perform substantially the same function in substantially the same way to achieve substantially the same result as the helical hydraulic rotary actuators disclosed herein.

Therefore, specific structural and functional details disclosed above are not to be interpreted as limiting the claimed invention, but merely as a basis for the claims and for teaching one skilled in the art to variously employ the present invention in any appropriately detailed manner. Changes may be made in the details of construction, arrangement or operation of the invention without departing from the spirit of the invention, especially as defined in the following claims.

I claim:

1. A platform leveling system for an aerial lift, said aerial lift comprising a base, a lower boom pivotally connected to the base, an upper boom pivotally connected to the lower boom, a platform pivotally connected to the upper boom, a first hydraulic boom cylinder assembly for raising and lowering the lower boom relative to the base, and a second hydraulic boom cylinder assembly for raising and lowering the upper boom relative to the lower boom, said platform leveling system comprising:

a first helical hydraulic rotary actuator connected to the base and lower boom, with said first hydraulic boom cylinder assembly exerting a significant mechanical advantage over said first helical hydraulic rotary actuator so that rotational movement of the lower boom relative to the base causes a displacement of hydraulic fluid in said first helical hydraulic rotary actuator;

a second helical hydraulic rotary actuator connected to the lower boom and upper boom, with said second hydraulic boom cylinder assembly exerting a significant mechanical advantage over said second helical hydraulic rotary actuator so that rotational movement of the upper boom relative to the lower boom causes a displacement of hydraulic fluid in said second helical hydraulic rotary actuator;

a third helical hydraulic rotary actuator connected to the upper boom and platform, with hydraulic fluid in said third helical hydraulic rotary actuator becoming displaced in response to a displacement of fluid in the first helical hydraulic rotary actuator and in response to a displacement of fluid in the second helical hydraulic rotary actuator so as to cause rotational movement of the platform relative to the upper boom;

said first, second and third helical hydraulic rotary actuators being hydraulically interconnected such that:

rotational movement of the lower boom relative to the base causes a substantially equal amount of rotational movement of the platform relative to the upper boom; and rotational movement of the upper boom relative to the lower boom causes a substantially equal amount of rotational movement of the platform relative to the upper boom.

2. The platform leveling system of claim 1, further comprising a holding valve hydraulically connected to the third helical hydraulic rotary actuator for locking the platform in its position relative to the upper boom in the event of a loss of hydraulic pressure in the system.

3. The platform leveling system of claim 1, further comprising a cross-over relief valve for relieving hydraulic pressure in the system in the event such pressure exceeds a preset limit.

4. The platform leveling system of claim 1, wherein the lower boom comprises a telescopic boom.

5. A platform leveling system for an aerial lift comprising:

a base;

a lower boom pivotally connected to the base for rotational movement about a first shaft;

an upper boom pivotally connected to the lower boom for rotational movement about a second shaft;

a platform pivotally connected to the upper boom for rotational movement about a third shaft;

a first hydraulic rotary actuator connected to the base and to the lower boom, said first hydraulic rotary actuator having an axis of rotation which is substantially concentric to said first shaft;

a second hydraulic rotary actuator connected to the lower boom and to the upper boom, said second hydraulic rotary actuator having an axis of rotation which is substantially concentric to said second shaft;

a third hydraulic rotary actuator connected to the upper boom and to the platform, said third hydraulic rotary actuator having an axis of rotation which is substantially concentric to said third shaft;

said first, second and third hydraulic rotary actuators being hydraulically interconnected such that:

rotational movement of the lower boom relative to the base causes the first hydraulic rotary actuator to displace hydraulic fluid;

rotational movement of the upper boom relative to the lower boom causes the second hydraulic rotary actuator to displace hydraulic fluid; and the third hydraulic rotary actuator displaces hydraulic fluid in response to the displacement of hydraulic fluid in the first and second hydraulic actuators to thereby rotate the platform relative to the upper boom.

6. The platform leveling system of claim 5, further comprising a holding valve hydraulically connected to the third hydraulic rotary actuator for locking the platform in its position relative to the upper boom in the event of a loss of hydraulic pressure in the system.

7. The platform leveling system of claim 5, further comprising a cross-over relief valve for relieving hydraulic pressure in the system in the event such pressure exceeds a preset limit.

8. The platform leveling system of claim 5, wherein the lower boom comprises a telescopic boom.

9. An aerial lift comprising:

an articulating boom for raising and lowering a work platform, said boom having a lower end coupled to a base and an upper end coupled to the work platform;

a lower hydraulic rotary actuator, said lower hydraulic rotary actuator having a first member which is concentrically rotatable relative to a second member, said first member being attached to the base and said second member being attached to the lower end of the boom, and rotation of the first member relative to the second member causes a displacement of hydraulic fluid by the lower hydraulic rotary actuator; and, an upper hydraulic rotary actuator, said upper hydraulic rotary actuator having a third member which is concentrically rotatable relative to a fourth member, said third member being attached to the upper end of the boom and said fourth member being attached to the work platform, and the upper hydraulic rotary actuator being hydraulically interconnected to the lower hydraulic rotary actuator so that the displacement of hydraulic fluid by the lower hydraulic rotary actuator results in the displacement of a substantially equal amount of hydraulic fluid in the upper hydraulic rotary actuator thereby causing the fourth member to rotate relative to the third member;

wherein articulation of the boom relative to the base results in an equal and opposite amount of articulation of the work platform in order to maintain the platform in a level position.

10. The aerial lift of claim 9, wherein:

the boom comprises an upper section and a lower section;

the upper section being coupled to the lower section for articulation about an elbow joint; and, the aerial lift further comprises:

an intermediate hydraulic rotary actuator, said intermediate hydraulic rotary actuator having a fifth member which is concentrically rotatable relative to a sixth member, said fifth member being attached to the lower section of the boom and said sixth member being attached to the upper section of the boom, and rotation of the fifth member relative to the sixth member causes a displacement of hydraulic fluid by the intermediate hydraulic rotary actuator;

the intermediate hydraulic rotary actuator being hydraulically interconnected to the upper hydraulic rotary actuator so that the displacement of hydraulic fluid by the intermediate hydraulic rotary actuator results in the displacement of a substantially equal amount of hydraulic fluid in the upper hydraulic rotary actuator thereby causing the fourth member to rotate relative to the third member;

wherein articulation of the upper section of the boom relative to the lower section results in an equal and opposite amount of articulation of the work platform in order to keep the platform in a level position.

11. The aerial lift of claim 10, wherein:

articulation of the boom about the base defines a first axis;

rotation of the first member of the lower hydraulic rotary actuator relative to the second member defines a second axis; and the first axis is in substantial alignment with the second axis.

12. The aerial lift of claim 11, further comprising means for relieving stress on said lower hydraulic rotary actuator in the event of a slight misalignment of the first and second axes.

13. The aerial lift of claim 12, wherein:

the means for relieving stress comprises a first cam, said cam having one end fastened to the lower hydraulic rotary actuator, and another end fastened by a first pin and first eccentric bushing to the boom.

14. The aerial lift of claim 13, wherein:

articulation of the upper section of the boom about the lower section defines a third axis;

rotation of the fifth member of the intermediate hydraulic rotary actuator relative to the sixth member defines a fourth axis; and, the third axis is in substantial alignment with the fourth axis.

15. The aerial lift of claim 14, further comprising means for relieving stress on the intermediate hydraulic rotary actuator in the event of a slight misalignment of the third and fourth axis.

16. The aerial lift of claim 15, wherein the means for relieving stress comprises a second cam, said second cam having one end fastened to the intermediate hydraulic rotary actuator, and another end fastened by a second pin and a second bushing to the boom.

17. An aerial lift comprising:

a base;

a lower boom coupled for rotational movement relative to the base;

an upper boom coupled for rotational movement relative to the lower boom;

a platform coupled for rotational movement relative to the upper boom;

a first hydraulic cylinder assembly for moving the lower boom relative to the base;

a second hydraulic cylinder assembly for moving the upper boom relative to the lower boom;

first rotary means for displacing hydraulic fluid in response to rotational movement of the lower boom relative to the base;

second rotary means for displacing hydraulic fluid in response to rotational movement of the upper boom relative to the lower boom; and third rotary means for displacing hydraulic fluid in response to the displacement of hydraulic fluid by the first and second rotary means to thereby rotate the platform relative to the upper boom.

18. The aerial lift of claim 17, wherein the first rotary means for displacing hydraulic fluid comprises a first helical hydraulic rotary actuator connected to the base and the lower boom.

19. The aerial lift of claim 18, wherein the second rotary means for displacing hydraulic fluid comprises a second helical hydraulic rotary actuator connected to the lower boom and the upper boom.

20. The aerial lift of claim 19, wherein the third rotary means for displacing hydraulic fluid comprises a third helical hydraulic rotary actuator connected to the platform and the upper boom.

21. The aerial lift of claim 20, further comprising means for locking the platform in its position relative to the upper boom in the event of a loss of hydraulic pressure.

22. The aerial lift of claim 21, wherein the means for locking the platform comprises a hydraulic holding valve connected to the third helical hydraulic rotary actuator.

23. The aerial lift of claim 20, further comprising means for relieving hydraulic pressure in the event such pressure exceeds a preset limit.

24. The aerial lift of claim 23, wherein the means for relieving hydraulic pressure comprises a cross-over relief valve.

25. The aerial lift of claim 19, wherein the first hydraulic cylinder assembly exerts a significant mechanical advantage over the first helical hydraulic rotary actuator.

26. The aerial lift of claim 25, wherein the second hydraulic cylinder assembly exerts a significant mechanical advantage over the second helical hydraulic rotary actuator.

27. The aerial lift of claim 20, further comprising hydraulic hoses for interconnecting the first, second and third helical hydraulic rotary actuators, said hoses having a pressure capacity substantially higher than the normal operating pressure of the first, second and third helical hydraulic rotary actuators.

* * * * *